United States Patent [19]

Whitfield

[11] Patent Number: 4,995,607

[45] Date of Patent: Feb. 26, 1991

[54] INTERACTIVE SPORTS TRAINING DEVICE

[76] Inventor: Terry B. Whitfield, 2729 Carmar Dr., Los Angeles, Calif. 90046

[21] Appl. No.: 453,143

[22] Filed: Dec. 12, 1989

Related U.S. Application Data

[63] Continuation of Ser. No. 239,114, Aug. 31, 1988, abandoned.

[51] Int. Cl.[5] ..... A63B 69/40

[52] U.S. Cl. ..... 273/26 R; 273/26 D; 272/3

[58] Field of Search ..... 273/26 A, 26 R, 26 D, 273/29 A, 177 A, 183 R, 183 B, 184 R, 185 A, 371, 372, 378, 379, 381, 382, 386, 387, 388, 390, 89, 90; 272/3

[56] References Cited

U.S. PATENT DOCUMENTS

| | | | |
|---|---|---|---|
| 856,216 | 6/1907 | Black | 273/90 |
| 2,040,228 | 5/1936 | Whiteley | 273/26 A |
| 2,064,025 | 12/1936 | Miner | 273/89 |
| 2,657,931 | 11/1953 | Burrell | 273/26 R |
| 3,349,620 | 10/1967 | Speiser | 273/184 R |
| 3,531,116 | 9/1970 | Trzesniewski | 273/26 R |
| 3,591,184 | 7/1971 | Conklin | 273/185 A |
| 3,655,202 | 4/1972 | Gautraud | 273/184 R |
| 3,769,894 | 11/1973 | Conklin | 273/185 A |
| 4,160,942 | 7/1979 | Lynch et al. | 273/184 R |
| 4,199,141 | 5/1980 | Garcia | 273/26 A |
| 4,257,594 | 3/1981 | Conrey et al. | 273/29 A |
| 4,343,469 | 8/1982 | Kunita et al. | 273/185 A |

FOREIGN PATENT DOCUMENTS

| | | | |
|---|---|---|---|
| 0083316 | 7/1983 | European Pat. Off. | 273/29 A |
| 8500530 | 2/1925 | Fed. Rep. of Germany | 273/26 D |
| 915346 | 1/1963 | United Kingdom | 273/184 R |

OTHER PUBLICATIONS

Popular Science 7/82, p. 63.
The Evening Star, 10/63.

*Primary Examiner*—Theatrice Brown
*Attorney, Agent, or Firm*—Christie, Parker & Hale

[57] ABSTRACT

An interactive sports training device comprises a screen mountable adjacent a playing area. An array of sensors is mounted on the back of the screen for generating an electrical sensor signal in response to the impact of an object against the screen, the sensor signal being representative of the location, and preferably force, of the impact. A programmed central processing unit receives the sensor signal and generates a response signal. A display receives the response signal and displays a preselected message dependent on the response signal received. The message generates is thus dependent on the location, and preferably force, of the impact.

25 Claims, 5 Drawing Sheets

INTERACTIVE SPORTS TRAINING DEVICE

CROSS-REFERENCE TO RELATED APPLICATIONS

This is a continuation of application Ser. No. 07/239,114, filed Aug, 31, 1988 ABN.

FIELD OF THE INVENTION

This invention pertains to sports play simulators and more specifically to an interactive sports training device.

BACKGROUND OF THE INVENTION

Athletes constantly need to improve the fundamental skills of their sport. Game play is a very inefficient way of doing this, so many training aids have been developed.

For example, in baseball there are batting cages. A batting cage normally consists of a completely enclosed room with the walls being made of chain link fence, or the like. The baseball batter stands at one end of the room, and a pitching machine is positioned an appropriate distance from the batter. The machine pitches balls to the batter and the batter tries to hit the pitches. When hit, a ball strikes a chain link wall of the batting cage and falls to the ground where it can be easily retrieved and returned to the pitching machine when the exercise is over. In a matter of minutes the batter obtains far more practice batting than he would during a baseball game that lasted for hours. In addition, the player obtains this practice alone. No pitcher, catcher, fielder, nor field is required. However, the batting cage does usually require a relatively large area.

For golf, driving ranges accomplish a similar goal. A golfer can practice his swing for driving and chipping much more efficiently than he could during the course of a normal game. Here again, driving ranges require a very large open area.

Other sports have their own specialized equipment which allow one player to practice game fundamentals. However, all of these training aids do a poor job of simulating game play. The batting cage, for example, does not indicate to the batter whether a batted ball would have resulted in a hit or an out. Also, a typical batting cage cannot adjust for different strategies encountered when playing against an opposing team.

SUMMARY OF THE INVENTION

The present invention provides an interactive sports training device adaptable to a large number of different sports. It gives a player instant feedback. It tells him whether he has made a good hit, kick, pass, shot, etc. immediately after he makes it. This makes the practice session more valuable because corrections can be made immediately. It also creates a more realistic practice area which improves the player's feel for the game. It also makes the practice more enjoyable and allows the player to practice the quick timing and speedy response so important in competitive play in addition to the basic skills.

The interactive training device comprises a screen, preferably containing a representation of a playing field for the particular sport in question, as seen by a player at a particular location on that field. The screen is mounted in front of a playing area simulating that particular field location.

A plurality of sensor means are mounted on the screen and are coupled to a display unit. Each sensor means is electrically connected to a particular display means of the display unit. When a ball or other object strikes the screen, one or more of the sensor means are triggered to generate an electrical signal for activating the display means to which the sensor means are attached. The display means, when activated, transmits a visual or audio signal to the player.

Preferably, means are provided for maintaining the display means signal for a predetermined period of time. In one preferred embodiment of the invention, generation of an electrical signal by one or more specific sensor means also activates a switch or the like, for preventing the activation of a specific display means and thereby prevent simultaneous activation of two or more contradictory display means signals.

A preferred application of the present invention comprises an interactive baseball batting training device. In such a device, a ball hit by a batter strikes the screen, triggering one or more sensor means. The sensor means generate an electrical signal which is carried to and activates a particular display means, e.g., a light, of the display unit. Activation of the display means creates a message or signal to the batter indicating, for example, whether the hit ball resulted in an out or hit, and preferably indicating whether the hit was a single, double, triple, or home run.

Switch means are preferably provided to avoid a situation wherein two separate display means, e.g., one for indicating an out and one for indicating a hit, are activated simultaneously. The switch means are activated by the electrical signal which also activates one of the display means. When activated, the switch means interrupts the electrical signal which would otherwise activate the second display means.

In a particular preferred embodiment of the invention, the sensor means are coupled to a central processing unit. In such an embodiment, when a ball strikes the screen, the sensor means generates a signal representative of the location and preferably the force of the impact, which is sent to the central processing unit. The central processing unit analyzes the received signal and then activates a display unit comprising an audio and/or visual display to transmit a selected message to the player which is dependent on the sensor signal received by the central processing unit, and, hence, dependent on the screen location hit by the ball.

Depending on the sport being simulated, the interactive training device may comprise a means for projecting an object into the playing area. For example, in an interactive baseball batting device, the projecting means may comprise a pitching machine. In such an embodiment, a switch is preferably provided for remotely activating the projecting means.

In another particularly preferred embodiment of the invention, the interactive training device comprises a central processing unit which is programmed to prompt the player in various ways, indicating, for example, the changing location of opposing players. Using such a feature, the player can actually play against the training device or against another player controlling the training device in simulated game situations.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
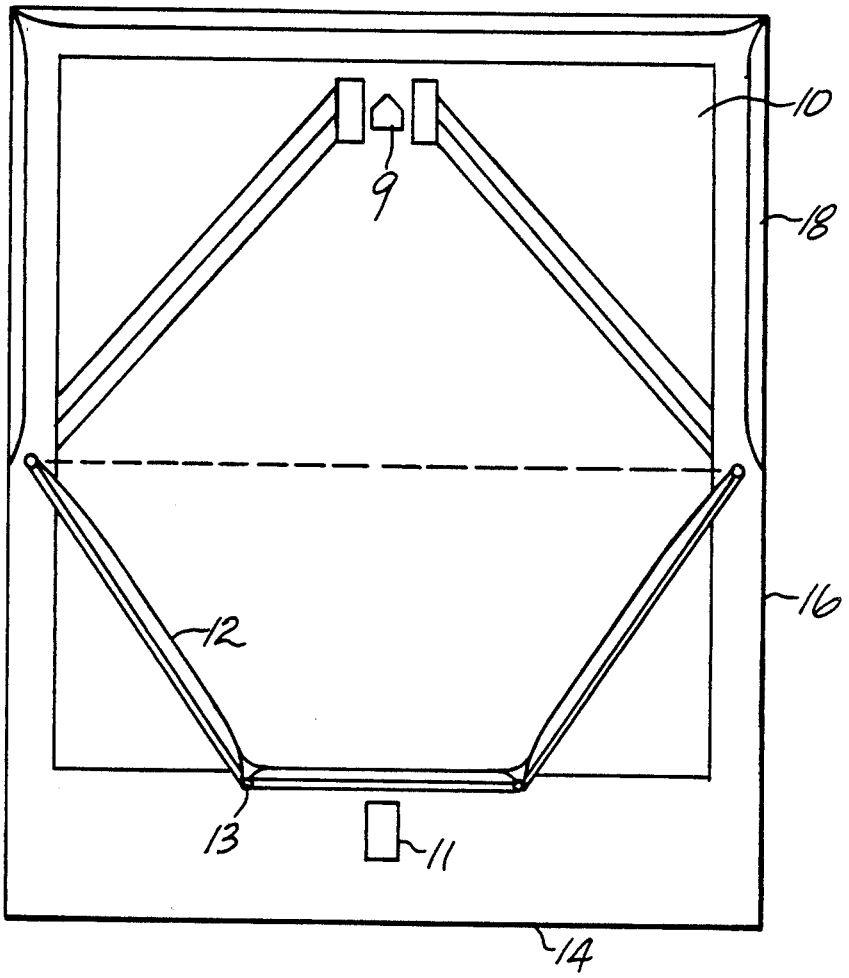
FIG. 1 is a top view of the preferred interactive training device for baseball batting practice.
Figure 2:
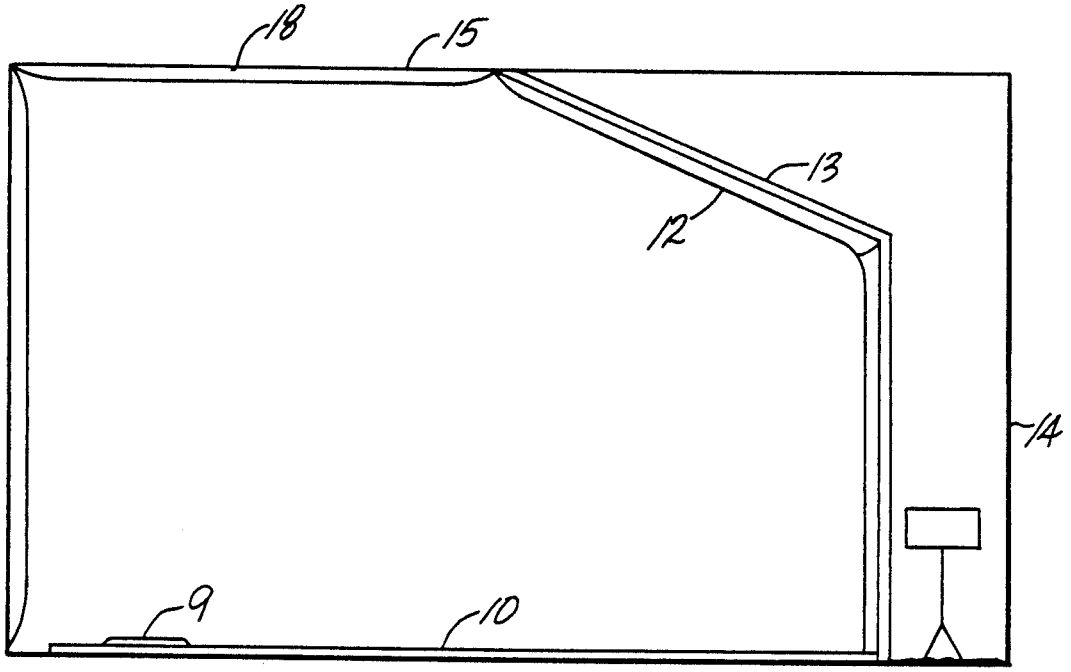
FIG. 2 is a side cross sectional view of the interactive training device shown in FIG. 1.

In a particularly preferred embodiment of the present invention, as shown in FIGS. 1 and 2, there is provided an interactive sports play simulator designed specifically for baseball batting practice. In the embodiment shown, the interactive sports play simulator is arranged in a relatively small room, e.g., about the same size as a conventional racquetball court.

A portion of the floor of the room is covered with a mat 10 which simulates the home plate area and the infield area directly in front of home plate in a baseball diamond. The mat 10 may be made of any suitable material. For example, the grassy areas may comprise artificial grass or green indoor-outdoor carpeting. The dirt areas may comprise brown indoor-outdoor carpeting or the like. Preferably, a regulation home plate 9 is used. The precise dimensions of the markings on the mat may vary, as desired, depending on the size of the field which is being simulated, e.g., major league, little league, etc.

In front of the player, there is a large screen 12. In the rectangular room of this embodiment, the screen 12 is mounted on a supporting frame 13 and has a center section which extends parallel with the wall 14 opposite a player standing adjacent home plate 9. Two side sections extend forwardly from the side sections to walls 16 and 17, and a top section extends upwardly from the center and side sections to the ceiling 15. It is apparent that the screen can have any other desired shape, e.g., flat, curved, etc. The screen 12 is made of a strong flexible material like canvas, or the like, so that it can absorb the impact of the high speed baseballs.

At the end of the room remote from the home plate 9, there is provided an automatic pitching machine 11. Any conventional pitching machine may be used. In the embodiment shown, the pitching machine 11 is behind the screen and an opening is provided in the screen directly in front of the pitching machine. If desired, the pitching machine 11 may be located in front of the screen 12.

The exposed walls and ceiling of the room, i.e., the portions not covered by the screen 12, are preferably covered with pads 18 to deaden the impact of high speed baseballs and absorb most of their momentum. Chain link fencing spaced apart from the walls may also be used.

Figure 3:
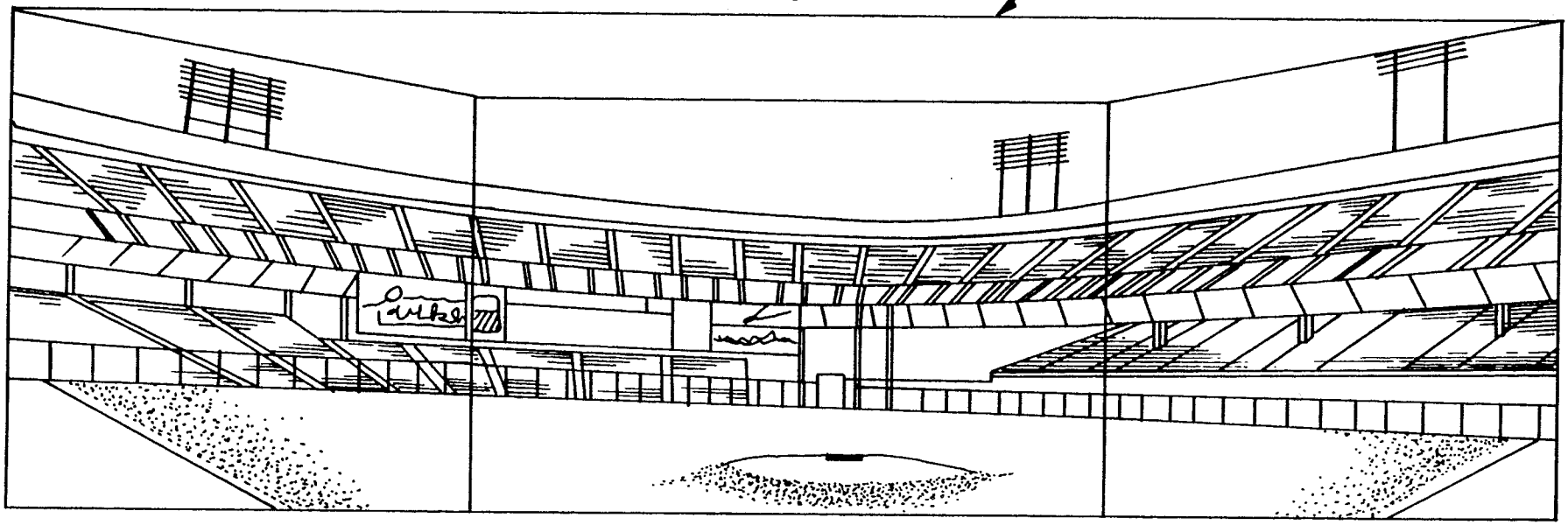
FIG. 3 is a front view of a preferred screen showing a representation of a baseball playing field.

With reference to FIG. 3, the screen 12 is colored or painted to look like a stadium as seen by a batter. Representations of infielders and outfields (not shown) may be included on the screen in appropriate positions, if desired. The design on the screen 12 is preferably integrated with the mat 10. Thus, the visual appearance of the simulator to a batter is similar to that encountered by a batter in a real game.

Figure 4:
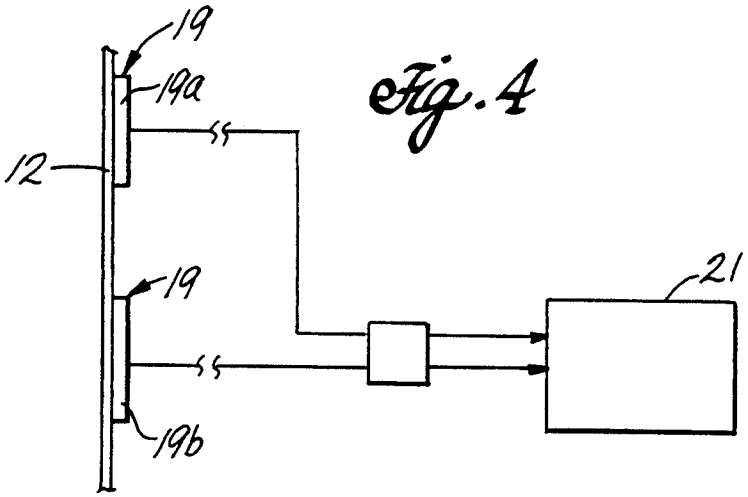
FIG. 4 is a schematic diagram showing the screen, sensor means and display.

With reference to FIG. 4, a sensor assembly is mounted on the back side of the screen 12. In the embodiment shown, the sensor assembly comprises an array of sensors 19. The sensors 19 may be of any suitable type. For example, membrane switch type or piezoresistive type sensors such as strain gauges or piezofilm type sensors are suitable. The sensors 19 are activated when the screen in front of the sensor is hit by a baseball.

When activated, the sensors 19 send an electrical signal to a display unit 21. The display unit 21 may be of any suitable design. A simple display unit 21 may comprise, for example, a series of lamps wherein each lamp corresponds to a particular result, e.g. home run, single, out, etc. Each sensor 19 in predetermined areas of the screen is electrically connected to one of the lamps. A timer or the like is preferably provided so that, once activated, the lamp will remain activated for a predetermined period, e.g. 5 seconds.

In one embodiment, the screen 12 comprises two distinct areas, e.g. "hit" and "out" areas. In another embodiment, the screen 12 comprises five distinct areas, e.g. "single", "double", "triple", "home run", and "out" areas. Impact of a baseball on the screen in one of the areas results in the activation of a sensor 19 behind the screen 12 in that area and the generation of an electric signal. All of the sensors in a particular area are electrically connected by a select lamp of the display unit 21. Hence a ball hitting anywhere in a particular area will activate a particular lamp which indicates, for example, whether the batted ball resulted in a "hit", "out", etc.

Activation of sensors 19 in two or more distinct areas, e.g. "hit" and "out" areas may occur if a ball strikes the screen between sensors at the border of adjacent areas. To avoid a situation wherein two lamps of the display unit are activated, generating two contradictory display signals, it is preferred that a relay or other suitable switch be provided which is activated by the electrical signals from sensors of one area and interrupts the electrical signals from the sensors in an adjacent area.

For example, with reference to FIG. 4, a relay 20 is electrically connected to the circuit between a first set of sensors 19*a*, i.e., the sensors of a first area and the corresponding display lamp, so that the relay is activated when one or more of the first sensors are activated. When activated, the relay 20 opens or interrupts the circuit between a second set of sensors 19*b*, i.e., sensors of a second adjacent area, its corresponding display lamp, thus preventing activation of that display lamp.

In a particular preferred embodiment of the invention the sensors 19 are electrically connected to a central processing unit which comprises a computer, microcomputer or the like. The central processing unit is at a safe location, e.g. behind the screen or even outside the room.

The central processing unit analyzes the signals received from the sensors and activates a visual display in the room with the player to indicate to the batter the result of his last effort.

Impact of a baseball against the screen results in the sensor assembly generating an electrical signal representative of the location of the impact on the screen and, more preferably, an electrical signal representative of the impact location and the force of the impact.

Figure 5:
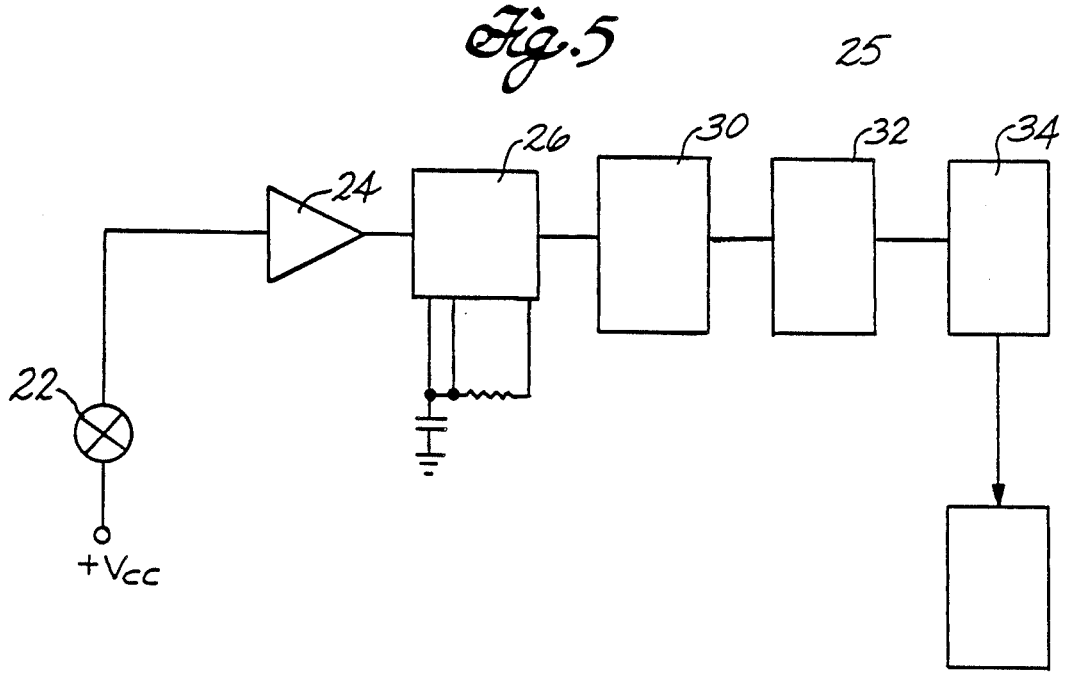
FIG. 5 is a schematic block diagram of a preferred central processing unit.

It is understood that, in such a preferred embodiment, the sensors and central processing unit may be of any suitable design. For example, with reference to FIG. 5, each sensor in the array may comprise a membrane switch 22 which is coupled to a Schmidt trigger trigger 24. When the membrane switch 22 is activated by a ball impacting the screen, it sends a pulse to the Schmidt trigger 24 which in turn outputs a logical pulse. This logical pulse triggers a monostable multivibrator 26 which outputs a timing pulse, whose width is controlled by a resistive capacitive time constant, to the central processing unit 25.

The central processing unit 25 comprises an "OR" logic array 30 with one hardwired eleven bit memory address for each membrane switch. The result is that every membrane switch corresponds to a specific memory address. When that switch is hit, that address is enabled and stored in a random access memory 32 (RAM). A microcomputer 34 can then read which switch has been hit by enabling the RAM and reading the addresses stored there.

The microcomputer 34 transmits a signal to the display 36 to activate a particular lamp, depending on the information received. Preferably, the visual display 36 comprises digital display means such as an LCD for forming words, numbers, and the like. Such a visual display 36 could be activated to display particular words corresponding to the result achieved, e.g. home run.

In addition to, or alternatively, the microcomputer 34 may activate an audio display. Such a display may comprise, for example, a speech synthesizer which may be activated to indicate the result. Alternatively, a tape player or the like may be activated to transmit one of a variety of prerecorded messages. Such a prerecorded message may comprise, in addition to the message, background crowd noises such as cheering or the like to increase the sense of realism and enjoyment. A prerecorded tape of background crowd noise may be played during the entire practice session, if desired.

Figure 6:
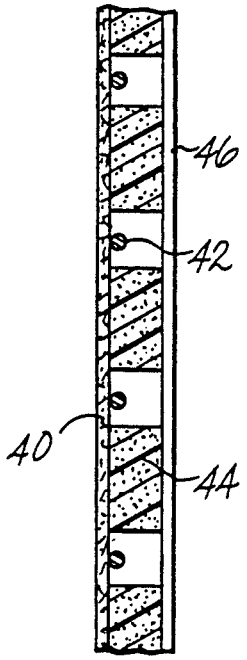
FIG. 6 is a cross-sectional view of another preferred sensor means.

Rather than applying an array of membrane switches to the back face of the screen, the sensor assembly may comprise a wire grid construction. In the exemplary embodiment shown in FIG. 6, the wire grid construction has four layers. The first layer 40 is the screen which contains a representation of the playing field as previously described. This is the part that the player sees. The second layer 42 comprises horizontal rows of wires. The third layer 44 comprises rows of a compressible material positioned between the horizontal wires, separating the second and fourth layers. The fourth layer 46 comprises rows of vertical wires.

The spacing of the horizontal and vertical wires may be varied as desired to increase or decrease the sensitivity of the assembly. Preferably, the wires are spaced sufficiently close together so that a ball lightly impacting the screen will result in contact between at least one horizontal wire and at least one vertical wire.

When the screen 12 is struck by a ball, the third layer 44 of compressible material is compressed, allowing electrical contact between the horizontal wires of the second layer 42 and the vertical wires of the fourth layer 46. This completes one or more circuits. The wires then send pulses to their respective "OR" logic inputs. Each wire is associated with a particular memory address in RAM. With this system, after each hit, the RAM contains the addresses of all the wires which were pushed together by the hit. The wires form a cartesian-coordinate system so that the location of the hit and its force can be determined.

The wire grid system has the advantage that fewer total addresses are required. To identify $m \times n$ points on the screen, this system requires only $m + n$ addresses. The membrane switch system described above would require $m \times n$ switches and the same number of addresses. The disadvantage of the wire grid system is that the microcomputer must use two addresses to locate the point of impact instead of just one.

With the wire grid system, the ball's velocity can be estimated by the number of circuits closed. For example, a light impact may result in contact between only one horizontal wire and one vertical wire, closing one circuit. Greater impact may result in contact between two or more horizontal and vertical wires, closing two or more circuits.

Figure 7:
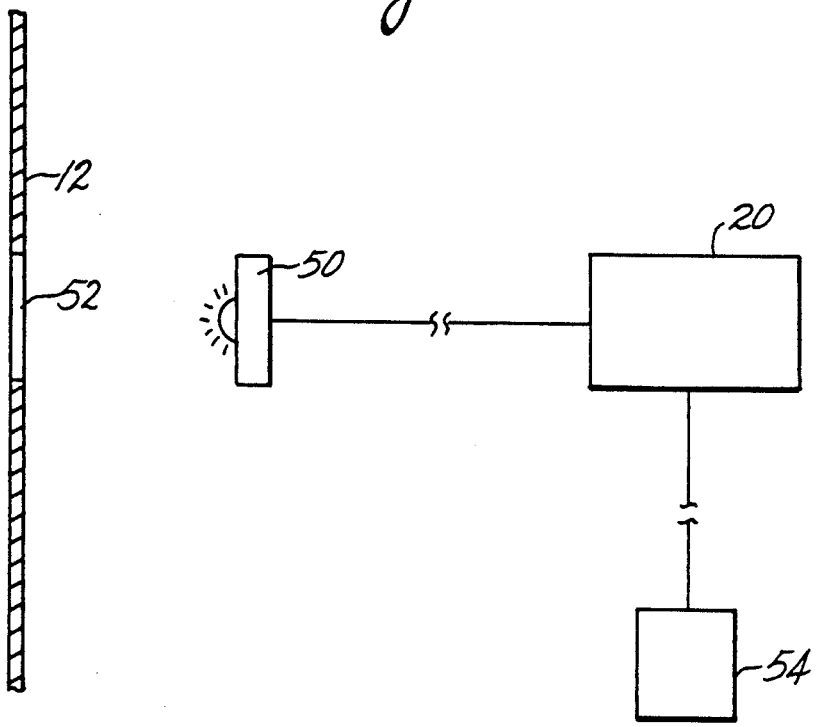
FIG. 7 is a schematic diagram showing the screen, prompting lamp, central processing unit and remote selector unit.

The microcomputer 34 may also be programmed to provide signals to prompt the batter before he hits the ball. For example, as shown in FIG. 7, in a particularly preferred embodiment of the invention, lamps 50, e.g., light-emitting diodes (LED's) may be provided at selected locations behind holes, or more preferably behind transparent areas 52 in the screen 12, where they are protected but still discernible to the batter. These lamps may indicate to the batter where the fielders are actually located. By providing lamps at a variety of locations, the microcomputer 34 can shift the location of the fielders, for example, to accommodate left or right handed hitters by activating or deactivating selected lamps. In conjunction with a shift of the fielder's locations, the microcomputer would be programmed to adjust the results of a hit according to the locations of the defensive players. Thus, a ball striking the screen at a particular location may be a "hit" in one defensive alignment, but an "out" in another defensive alignment.

Rather than the microcomputer automatically activating a signal to prompt the player before he hits the ball, the microcomputer may be programmed to allow a second player to select such a prompting signal by means of a remote selector unit 54 electrically connected to the central processing unit 20. The selector unit may comprise switches for moving the fielders to the left or right, in or out, etc. Activation of the switches sends signals to the microcomputer which, in turn, activates corresponding lamps behind the screen to advise the batter of the defensive alignment. The microcomputer would also be programmed to adjust the response to the signal received from the sensor assembly. In such an embodiment, a second player at a safe location can assume the role of opposing manager and adjust the defensive alignment of the fielders by means of the selector unit.

In another embodiment of the present invention, there is provided an interactive simulator for the practice of baseball pitching. In this embodiment, the screen has a representation of the backstop area of a baseball stadium directly behind home plate. If desired, the screen may also contain the representation of a batter. The playing area comprises a pitching mound and a home plate spaced an appropriate distance from the pitching mound. The screen is positioned directly behind home plate.

As in the previously described embodiments, the screen comprises a sensor assembly behind the screen electrically connected to a display unit. A pitch thrown against the screen activates one or more of the sensors, which in turn activate a lamp or the like of the display unit thereby indicating, for example, whether the pitch was a ball, strike, hit, etc.

In a preferred embodiment, the sensor assembly is electrically connected to a central processing unit which controls the display unit. The central processing unit comprises a computer, microcomputer, or the like which is programmed to analyze the signals received from the sensors and to transmit a signal to a visual and or audio display to indicate whether the pitch was, for example, a ball or strike. That is, the central processing unit is programmed to transmit a signal to the display indicating that the pitch was a ball if it receives a signal from a sensor located outside of the "strike zone." Likewise, the central processing unit would transmit a signal to the display indicating the pitch was a strike if sensors located within the strike zone were activated.

It is understood that the central processing unit may be programmed for additional functions. For example, it may be programmed to keep track of and display information such as the count, number of outs, the score, the inning, the number of base runners, etc. The central processing unit is also preferably programmed to transmit a signal to the display for indicating that the pitch resulted in a "hit" if sensors in a "sweet spot" e.g. in the heart of the strike zone, were activated. This would reinforce the idea of trying to pitch "on the corners" as opposed to "right down the middle" of the strike zone.

The central processing unit may be programmed to adjust the size of the strike zone, or the location and size of the "sweet spot." The central processing unit may also be programmed to adjust the response depending on the type of pitch thrown, e.g., curve ball, fast ball, etc. The adjustments may be made automatically by the central processing unit, or may be the result of data inputted into the central processing unit by the pitcher or a second player through a remote selector unit. By using a remote selector unit, a second player may adjust the location of the "sweet spot" to simulate a batter "looking for" a pitch in a particular location, e.g. "low and outside".

In a particularly preferred embodiment of the invention, the central processing unit comprises a computer or microcomputer which is programmed to change the size of the strike zone, the location and size of the sweet spot, the type of pitch, etc., to provide a prompting signal to the pitcher of such changes and to adjust the response as a result of such changes, according to data imputed into the computer or microcomputer in the form of a tape, floppy disk or the like. The disk or tape may comprise data to simulate a variety of batters. Hence, an entire opposing team may be simulated. Alternatively, the data may be entered by a keyboard.

In one embodiment, an entire major league team, whose team member's hitting characteristics are known, may be simulated. In such an embodiment, one of the prompting signals may be the name of the major league player being simulated. If desired, the computer may be programmed so that a second player with a remote selector unit could "pinch hit," i.e., substitute, one batter for another as in a real game situation.

In an embodiment designed particularly for two pitchers, the disk or tape comprises information about two different teams. In the embodiment, the computer or microcomputer would be programmed to switch from one team to another after three outs are achieved. In this way, one player may pitch against one "team", and, after achieving three outs, the second player would pitch against the second team, and so on, thus simulating a real game.

In another embodiment of the invention, there is provided an interactive simulator for the practice of throwing footballs. In this embodiment, the screen is set up in front of a playing area and preferably displays a representation of a football field. Representations of football players and/or the stadium may also be present, if desired.

In this embodiment, the player, playing the quarterback position takes a football and drops back to pass. The quarterback then throws the ball to a particular target, e.g. a "receiver". "Completion", "interception" and "incomplete pass" zones may be set up around the "receiver". Impact of the football in one of these zones activates a sensor in that zone which, in turn, activates a corresponding lamp or the like in the display unit.

Again, it is preferred that the interactive simulation comprises a central processing unit for receiving and analyzing the signals from the sensor. In such an embodiment the central processing unit may be programmed not only to receive and analyze signals from the sensors and to transmit signals to the display unit, but may also be programmed to transmit a series of signals to lamps located behind openings in the screen to indicate the moving location of the receivers in their pass patterns. The player would then throw the ball to the receiver's anticipated location. The football impacts the screen, activating one or more sensors depending on the force and location of the impact, which then transmits electrical signals to the central processing unit. The central processing unit analyzes the received signals and then transmits signals to the display to indicate whether the pass was complete, incomplete, or intercepted.

The central processing unit is preferably programmed to transmit more than one series of signals to thereby simulate more than one pass pattern. A remote selector unit connected to the central processing unit is preferably provided so that the player, i.e. quarterback, can "call" different plays as desired.

In yet another embodiment of the invention, there is provided an interactive sport simulator for tennis practice. In this embodiment of the invention, the playing area is a half tennis court. The other half of the tennis court and the net are represented on a screen mounted in front of the player.

Here, the screen is preferably mounted against a solid backboard so that a tennis ball impacting the screen will bounce back to the player to simulate an opposing player hitting the ball back. The sensing assembly lies between the screen and the backboard. Impact of a tennis ball against the screen activates one or more sensors which in turn activate a display lamp or the like for indicating whether the ball was "in play", "out of bounds", or the like.

A central processing unit may be provided and programmed to activate the display for indicating if a ball hit by a player is "out", depending on the location and force of the ball on the screen. If the ball is not "out", the player continues to hit the ball against the screen.

In a preferred embodiment involving a central processing unit, an array of lamps are positioned behind holes or transparent areas of the screen. Here, the central processing unit is programmed to read the location and force of the hit, to estimate where an opposing player would have to be to return the hit and then to indicate that location to the player by activating a lamp at that location. The player then tries to hit the ball to a location difficult for the "computer-generated opponent" to return. The central processing unit is preferably programmed to determine not only whether the next hit was "in" or "out", but whether the hit was a "winner", i.e., not returnable by the opponent.

The interactive sports simulator of the present invention can be adapted for other sports, such as soccer. In a preferred soccer embodiment, the screen would contain a representation of the goal area. The object would be to kick a soccer ball to a particular location within the goal, e.g., to the corners. Upon impact of the ball on the screen, the sensing assembly would transmit a signal to the display unit which would transmit a signal representative of the result, e.g., a goal, a miss, or perhaps that the goal was caught by the goalie.

A central processing unit could be provided to receive signals from the sensor assembly representative of the location of the impact. The central processing unit would analyze the received signal and transmit an appropriate signal to the display. If desired, the central processing unit may be programmed to activate one or more lamps located behind the screen as previously described to prompt a player to kick to the indicated location. The central processing unit would preferably be programmed to change such indicated location for each successive kicks.

In a particularly preferred embodiment, there is provided a means for projecting, e.g., rolling, a soccer ball into the playing area. Any suitable projecting means may be used. In this embodiment, the player would kick a moving soccer ball, attempting to strike a particular location.

In the embodiments of the invention described above, the screen and sensing assembly are mounted on an upright frame or solid support. For some sports, it may be desirable simply to lay the screen and sensing assembly on the ground, floor, or other horizontal surface or an inclined surface. For example, in an interactive volleyball simulator in accordance with the invention, the screen may be laid on a floor on one side of a volleyball net. The screen may contain markings or the like indicating where the opposing players are located.

If two players are available, one player may set the ball to the other player, who spikes the ball over the net and onto the screen. If only one player is present, a projecting means, for example, as described in U.S. Pat. No. 4,669,444, may be provided for projecting the ball upwardly to the desired "spiking" location. The sensing means would transmit a signal to the display which would indicate to the player the result of the spike, e.g., whether or not a point was scored.

With such a volleyball simulator, it is preferred that a central processing unit be provided and programmed to prompt the player spiking the ball to hit to a particular location on the screen, e.g., by activating one or more lamps behind the screen as previously described.

Thus, it can be seen that the present invention can be adapted to virtually any sport in which a projectile is sent towards a target, including baseball, football, tennis, soccer, volleyball, hockey, polo, squash, lacrosse, golf, and the like. It will be understood that these adaptations, as well as many others not mentioned are within the scope of the present invention.

What is claimed is:

1. An interactive sports training device comprising;

a screen mountable adjacent a playing area;

means for displaying a prompt to a player in the playing area;

sensor means for detecting the impact of an object hitting the screen and for generating a signal representative of the location of the impact on the screen;

programmable signal processing means, electrically connected to the sensor means and the prompt means, for generating a response signal dependent upon the sensor signal, and the displayed prompt and for adjusting the response signal to simulate an opposing player's ability to respond to an object hitting the screen; and display means electrically connected to the signal processing means for displaying a message dependent upon the response signal.

2. An interactive sports training device as claimed in claim 1, wherein the screen comprises a representation of a playing field.

3. An interactive sports training device as claimed in claim 1 further comprising means for throwing an object into the playing area and means for activating and deactivating the throwing means.

4. An interactive sports training device as claimed in claim 1 wherein the display means comprises means for visually displaying the message.

5. An interactive sports training device as claimed in claim 1 wherein the display means comprises means for audibly displaying the message.

6. An interactive sports training device as claimed in claim 1 wherein the signal generated by the sensor means is also representative of the speed of the object impacting the screen.

7. An interactive sports training device as claimed in claim 1 comprising a remote selector for inputting data to the signal processing unit for controlling the response signal adjustment.

8. An interactive sports training device as claimed in claim 1 wherein the prompt comprises a representation of an opposing player and the response signal adjustment comprises a representation of the opposing player's ability to respond to objects directed towards it.

9. An interactive sports training device as claimed in claim 1 wherein the playing area and the screen represent a baseball field from the perspective of home plate, the prompt comprises a representation of defensive baseball team player s and the response signal adjustment comprises a representation of the represented baseball team players' abilities to field baseballs.

10. An interactive sports training device as claimed in claim 1 wherein the playing area and the screen represent a baseball field from the perspective of a pitcher facing home plate, the prompt comprises a representation of a baseball batter and the response signal adjustment comprises a representation of the represented batter's batting sweet spot.

11. An interactive sports training device as claimed in claim 1 wherein the playing area and screen represent a tennis court, the prompt comprises a representation of an opposing player and the response signal adjustment comprises a representation of the opposing player's ability to return a tennis ball.

12. An interactive sports training device as claimed in claim 1 wherein the prompt means signals the response signal adjustment to the player.

13. An interactive baseball batting practice device comprising:

a screen comprising a representation of a baseball field as viewed from home plate in front of a batting area;

sensor means mounted on the screen for detecting the impact of a baseball hitting the screen and for generating an electric signal representative of the location of the impact on the screen and the speed of the baseball;

programmable signal processing means, electrically connected to the sensor means, for receiving and analyzing the signal generated by the sensor means and generating a selected response signal dependent upon the sensor signal received;

display means, electrically connected to the signal processing means, for receiving the response signal generated by the signal processing means and displaying at least one predetermined message dependent upon the response signal received; and means for throwing a baseball into the batting area.

14. An interactive baseball batting practice device as claimed in claim 13 wherein the display means comprises means for visually displaying the at least one predetermined message.

15. An interactive baseball batting practice device as claimed in claim 13 wherein the display means comprises means for audibly displaying at the at least one predetermined message.

16. An interactive baseball batting practice device as claimed in claim 13 wherein the at least one predetermined message indicates that a baseball impacting the screen resulted in a hit or out.

17. An interactive baseball batting practice device as claimed in claim 13 wherein the at least one predetermined message indicates that a baseball impacting the screen resulted in a single, double, triple, home run or out.

18. An interactive baseball batting practice device as claimed in claim 134 wherein the signal processing means is capable of generating two or more different response signals in response to at least one selected sensor signal, and the interactive baseball batting practice device further comprises remote selector means for manually selecting which response signal will be generated by the signal processing means in response to the selected signal received from the sensor.

19. An interactive baseball batting practice device as claimed in claim 13 further comprising means, electrically connected to the signal processing means, for displaying a prompt to a player in the batting area.

20. An interactive baseball batting practice device as claimed in claim 19 wherein the screen comprises two or more sets of transparent areas at selected locations and representative or two or more simulated opposing player alignments and the means for displaying a prompt comprises a set of lamps mounted behind each of transparent areas.

21. An interactive baseball batting practice device as claimed in claim 20 wherein the prompt comprises activation of a particular set of lamps.

22. An interactive baseball batting practice device as claimed in claim 19 further comprising remote selector means electrically connected to the signal processing means for manually selecting the prompt displayed to the player.

23. An interactive baseball batting practice device as claimed in claim 22 wherein the signal processing means is programmed for generating two or more different response signals in response to a selected sensor signal and wherein the response signal actually generated is determined by the prompt signal selected.

24. An interactive sports training device as claimed in claim 22 wherein the signal processing means is programmed for generating two or more different response signals in response to a selected sensor signal and wherein the response signal actually generated is determined at least in part by instructions input at a remote selector unit.

25. An interactive sports training device as claimed in claim 19 wherein the prompt comprises a representation of the locations of defensive baseball players on the screen.

* * * * *